US012679587B2

(12) United States Patent
Vadlja et al.

(10) Patent No.: US 12,679,587 B2
(45) Date of Patent: Jul. 14, 2026

(54) MACHINE AND METHOD FOR ROLL-PACKING OF MATTRESSES

(71) Applicant: L&P Swiss Holding GmbH, Wittenbach (CH)

(72) Inventors: Stjepan Vadlja, Cakovec (HR); Stjepan Kranjcec, Cakovec (HR); Dinko Ursic, Trnovec Bartolovecki (HR)

(73) Assignee: L&P Swiss Holding GmbH, Wittenbach (CH)

( * ) Notice: Subject to any disclaimer, the term of this patent is extended or adjusted under 35 U.S.C. 154(b) by 0 days.

(21) Appl. No.: 19/194,509

(22) Filed: Apr. 30, 2025

(65) Prior Publication Data

US 2025/0282514 A1 Sep. 11, 2025

Related U.S. Application Data

(63) Continuation of application No. 17/606,295, filed as application No. PCT/EP2020/062310 on May 4, 2020, now Pat. No. 12,319,461.

(30) Foreign Application Priority Data

May 21, 2019 (EP) ..... 19175698

(51) Int. Cl.
*B65B 63/04* (2006.01)
*B65B 11/04* (2006.01)
(Continued)

(52) U.S. Cl.
CPC ..... *B65B 63/04* (2013.01); *B65B 11/04* (2013.01); *B65B 59/001* (2019.05); *B65B 59/005* (2013.01); *B65B 63/026* (2013.01)

(58) Field of Classification Search
CPC ..... B65B 11/04; B65B 59/001; B65B 59/005; B65B 63/026; B65B 63/04
See application file for complete search history.

(56) References Cited

U.S. PATENT DOCUMENTS 4,114,530 A * 9/1978 Miller ..... B65B 63/04 53/118
4,164,177 A * 8/1979 Canfield ..... B30B 9/3082 100/88
(Continued)

FOREIGN PATENT DOCUMENTS

EP 734985 A1 10/1996
EP 0941952 A1 9/1999
(Continued)

OTHER PUBLICATIONS

European Patent Office; Search Report and Written Opinion in related International Patent Application No. PCT/EP2020/062310 dated Jun. 9, 2020; 11 pages.

*Primary Examiner* — Himchan Song
(74) *Attorney, Agent, or Firm* — Wood Herron & Evans LLP

(57) ABSTRACT

A roll-packing machine (100) is provided with a belt drive mechanism having a closed-loop belt (110). Further, the roll-packing machine (100) is provided with a feed mechanism (130, 140) configured to feed a mattress (10) to the belt (110). The belt drive mechanism is configured to form an inner loop (115) of the belt, to receive the mattress (10) in the inner loop (115), and to roll the mattress (10) by advancing the belt (110) while the mattress (10) is received in the inner loop (115). The inner loop (115) of the belt may thus act as a rolling chamber for the mattress (10).

23 Claims, 9 Drawing Sheets

(51) Int. Cl.
*B65B 59/00* (2006.01)
*B65B 63/02* (2006.01)

(56) References Cited

U.S. PATENT DOCUMENTS

| | | | | | |
|---|---|---|---|---|---|
| 4,353,512 | A * | 10/1982 | Rohrbacher | B21F 33/002 | 53/118 |
| 4,602,471 | A * | 7/1986 | Gray | B65B 63/024 | 100/88 |
| 4,928,898 | A * | 5/1990 | Audren | B65B 63/024 | 242/541.6 |
| 5,832,696 | A * | 11/1998 | Nagy | B65H 18/10 | 53/529 |
| 6,321,507 | B1 * | 11/2001 | Copeland | B65H 18/22 | 100/88 |
| 2015/0307303 | A1 * | 10/2015 | Pereira | A01F 15/18 | 242/548.2 |
| 2018/0194583 | A1 * | 7/2018 | Madsen | B65H 18/22 | |

FOREIGN PATENT DOCUMENTS

| | | | | |
|---|---|---|---|---|
| WO | WO-9700204 | A1 * | 1/1997 | B65H 29/008 |
| WO | 2008049812 | A1 | 5/2008 | |
| WO | 2018234040 | A1 | 12/2018 | |

* cited by examiner

MACHINE AND METHOD FOR ROLL-PACKING OF MATTRESSES

CROSS-REFERENCE TO RELATED APPLICATIONS

This application is a Continuation of U.S. patent application Ser. No. 17/606,295 filed Oct. 25, 2021 (Pending), which claims priority to International Patent Application No. PCT/EP2020/062310 filed May 4, 2020 (pending), the disclosures of which are incorporated by reference herein.

FIELD OF THE INVENTION

The present invention relates to a roll-packing machine for packaging of mattresses and to a method of roll-packing a mattress.

BACKGROUND OF THE INVENTION

With respect to packaging mattresses, a known packaging technique is roll packing. In this case the finished mattress is rolled to form a compact roll. Bands, tape or an outer wrapping may then be used to hold the roll in its form during storage or shipment. The roll may be formed manually. Alternatively, the roll may be formed in an automated manner, using a roll-packing machine. As described in WO 2018/049812 A1, such roll-packing machine may use a substantially cylindrical rolling chamber formed of a plurality of rollers.

However, using a rolling chamber formed of a plurality of rollers may result in rather high complexity of the roll-packing machine, e.g., because the arrangement of the rollers needs to be adjustable in order to conform to the outer shape of the mattress roll being formed and to allow removal of the mattress roll from the rolling chamber. Further, there may also be a risk of the mattress getting jammed between the rollers.

Accordingly, there is a need for techniques which allow for efficiently for roll-packing mattresses.

BRIEF SUMMARY OF THE INVENTION

The present invention provides a roll-packing machine according to claim 1 and to a method according to claim 12. The dependent claims define further embodiments.

Accordingly, an embodiment of the invention provides a roll-packing machine for packaging a mattress. The roll-packing machine comprises a belt drive mechanism having a closed-loop belt. Further, the roll-packing machine comprises a feed mechanism configured to feed the mattress to the belt. The belt drive mechanism is configured to form an inner loop of the belt, to receive the mattress in the inner loop, and to roll the mattress by advancing the belt while the mattress is received in the inner loop. The inner loop of the belt may thus act as a rolling chamber for the mattress.

According to an embodiment, the belt may be a segmented belt, i.e., be formed of multiple segments joined to each other by hinge joints. Flexibility of the belt may thus be provided by the pivot joints, rather than by the material of the segments. In this way, the belt may be provided with sufficient intrinsic stability to maintain the inner loop, without requiring dedicated support structures for maintaining the shape of the inner loop. Rather, stability of the inner loop may be provided by a first and a second roller, between which the inner loop is formed, by tension of the belt, and by a force generated by the mattress which is being fed to a portion of the belt between the first roller and the second roller.

According to an embodiment, the belt drive mechanism is configured to adjust a size of the inner loop. In this way, different sizes of the finished mattress roll may be accommodated. Further, the size of the inner loop may be controlled in accordance with the diameter of the mattress roll while the mattress is being rolled. In particular, the belt drive mechanism may be configured to increase the size of the inner loop while the mattress is being rolled.

According to an embodiment, the belt drive mechanism comprises a first roller and a second roller, with the inner loop being formed between the first roller and the second roller. In this case, the belt drive mechanism may be configured to adjust the size of the inner loop by individually controlling rotation of the first roller and the second roller. For example, with respect to an advancement direction of the belt, the first roller may be arranged upstream of the portion forming the inner loop, and the second roller may be arranged downstream of the portion forming the inner loop, i.e., the belt may be advanced from the first roller towards the second roller. In this case, the size of the inner loop may be increased by rotating the first roller at a higher rate than the second roller. The different rates of rotation may be achieved by providing the first roller and the second roller with individually controllable drive mechanisms. In addition or as an alternative, the first roller and the second roller could be provided with individually controllable brake mechanisms. By individually controlling rotation of the first roller and the second roller, the size of the inner loop may be adjusted in a highly efficient manner, without requiring complex mechanical structures.

According to an embodiment, the roll packing machine further comprises a belt tensioning mechanism configured to control tension of the belt while adjusting the size of the inner loop. In this way, changes of the size of the inner loop may be compensated and the tension of the belt may be kept at a desired level.

According to an embodiment, the tensioning mechanism is configured to control the tension of the belt by adjusting a size of one or more additional loops of the belt. For example, the belt drive mechanism may comprise multiple rollers for guiding the belt. At least some of the rollers may form the one or more additional loops. The tensioning mechanism may then be configured to adjust the size of the one or more additional loops by displacing two or more of the rollers relative to each other. By using a higher number of the additional loops, a required displacement range may be reduced, which may be beneficial in view of space-requirements for the roll-packing machine.

According to an embodiment, the belt drive mechanism comprises a first roller and a second roller, with the inner loop being formed between the first roller and the second roller. In this case, the roll-packing machine may further comprises an ejection mechanism configured to eject the rolled mattress from the inner loop by displacing the first roller away from the second roller. Due to the displacement, the inner loop may be opened so as to enable release and removal of the finished mattress roll from the inner loop. In some cases, the displacement may even have the effect that the portion of the belt between the first roller and the second roller takes a substantially straight-line form, so that the finished mattress roll can be easily moved from the roll-packing machine by rolling along the belt and/or by advancing the belt.

According to an embodiment, the roll-packing machine is further configured to wrap the rolled mattress by feeding a wrapping material, e.g., a plastic film, into the inner loop with the rolled mattress and advancing the belt to rotate the rolled mattress in the inner loop and wrap the wrapping material around the rolled mattress. In this case, the advancement of the belt may pull the wrapping material into the space between the rolled mattress and the inner loop. As a result, wrapping of the rolled mattress and formation of the finished mattress roll may be achieved in a highly efficient manner and with only a limited number of additional components, e.g., for feeding the wrapping material into the loop and/or for welding the wrapping material.

According to an embodiment, the feed mechanism is configured to compress the mattress while feeding the mattress to the belt. In this way, formation of a more compact mattress roll can be achieved.

According to a further embodiment, a method of packaging a mattress is provided. The method may be performed by the above roll-packing machine. The method comprises feeding the mattress to a closed-loop belt of a belt drive mechanism, forming an inner loop of the belt, receiving the mattress in the inner loop, and rolling the mattress by advancing the belt while the mattress is received in the inner loop. As mentioned above, the belt may be a segmented belt.

According to an embodiment, the method further comprises adjusting the size of the inner loop while the mattress is being rolled, e.g., by increasing the size of the inner loop so as to accommodate an increasing diameter of the mattress roll being formed.

According to an embodiment, the method further comprises wrapping the rolled mattress by feeding a wrapping material, e.g., a plastic film, into the inner loop with the rolled mattress and advancing the belt to rotate the rolled mattress in the inner loop and wrap the wrapping material around the rolled mattress. In this case, the advancement of the belt may pull the wrapping material into the space between the rolled mattress and the inner loop. As a result, wrapping of the rolled mattress and formation of the finished mattress roll may be achieved in a highly efficient manner.

According to an embodiment, the belt drive mechanism comprises a first roller and a second roller, with the inner loop being formed between the first roller and the second roller. In this case, the method may further comprise ejecting the rolled mattress from the inner loop by displacing the first roller away from the second roller. Due to the displacement, the inner loop may be opened so as to enable release and removal of the finished mattress roll from the inner loop. In some cases, the displacement may have the effect that the portion of the belt between the first roller and the second roller takes a substantially straight-line form, so that the finished mattress roll can be moved from the roll-packing machine by rolling along the belt and/or by advancing the belt.

BRIEF DESCRIPTION OF DRAWINGS

Embodiments of the invention will be described with reference to the accompanying drawings.

DETAILED DESCRIPTION OF EMBODIMENTS

Exemplary embodiments of the invention will be described with reference to the drawings. In particular, a roll-packing machine and a roll-packing method for mattresses will be described. While the following detailed description refers to packaging of mattresses as typically used for bedding furniture, it is to be understood that the illustrated concepts are not limited to this type of mattress, but for example could also be applied to other types mattress, e.g., like used in other types of furniture or even in applications not related to furniture, e.g., mattresses as used for sports or as components of buildings or vehicles. The mattresses may for example be based on foam material, one or more innerspring units, e.g., based on pocketed springs or a combination of pocketed springs and wire framework elements, or on a combination of a foam material and one or more innerspring units. The roll-packing machine and the method of the illustrated concepts are used for packaging the mattress by rolling, thereby forming a mattress roll which includes the rolled mattress and optionally also and outer wrapping around the rolled mattress. In some cases, the mattress may also be wrapped before being rolled, i.e., which means that the mattress roll may also include an inner wrapping formed around the mattress itself. It is noted that the features of different embodiments may be combined with each other unless specifically stated otherwise.

Figure 1A:
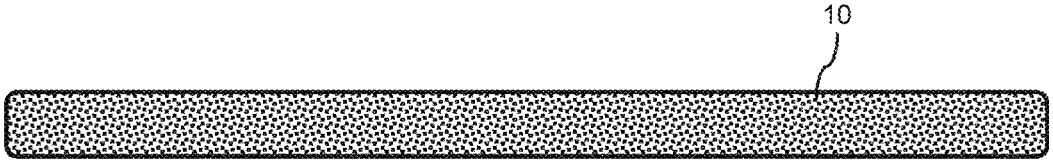
FIG. 1A illustrates a mattress to be roll-packed according to an embodiment.

FIG. 1A shows a sectional view for schematically illustrating a mattress 10. As mentioned above, the mattress 10 may be a mattress for bedding applications. The mattress may for example be based on foam material and/or on one or more innerspring units. If present, such innerspring unit may be based on pocketed springs or a combination of pocketed springs and wire framework elements. The mattress may have a substantially box-shaped outer form, with a typical length being in the range of 100 cm to 250 cm, a typical width being in the range of 60 cm to 200 cm, and a typical thickness being in the range of 5 cm to 30 cm. The mattress 10 is assumed to be compressible in the thickness direction.

Figure 1B:
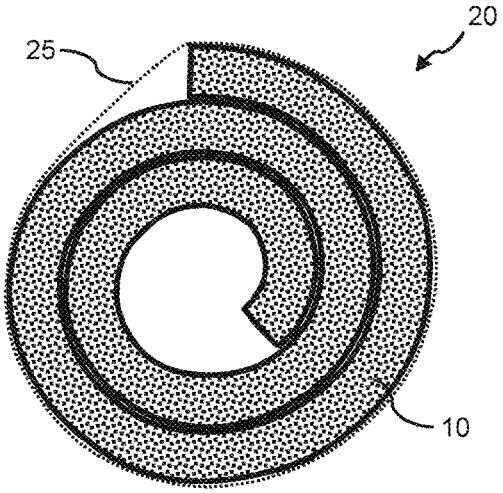
FIG. 1B illustrates a mattress roll as produced according to an embodiment.

FIG. 1B illustrates a mattress roll 20 which includes the rolled mattress 10 and an outer wrapping 25 enclosing the rolled mattress 10. The outer wrapping may for example be formed of one or more layers of a plastic film. The outer wrapping 25 ensures that the mattress 10 stays in the rolled state and thus keeps the mattress roll stable, e.g., during storage or transport. A typical outer diameter of the mattress roll is in the range of 30 cm to 80 cm, more specifically in the range of 40 cm to 60 cm. For forming the mattress roll 20, the mattress 10 is typically rolled around an axis parallel to its width direction. In some cases, an additional wrapping or other type of cover layer may also be provided on the mattress 10 before being rolled, resulting in the formation of inner layers of wrapping or cover material also in between the windings of the mattress roll 20.

Figure 2:
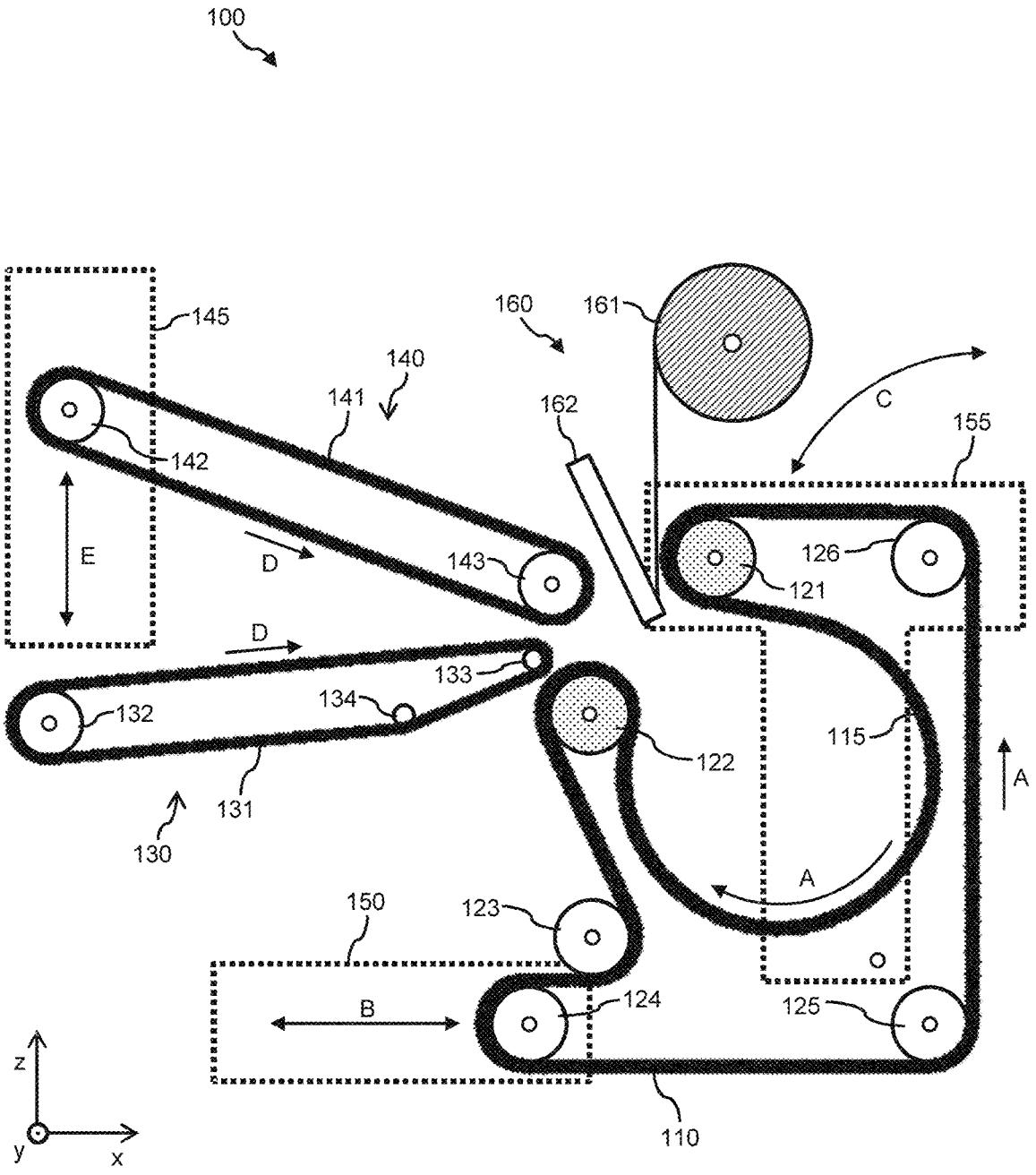
FIG. 2 schematically illustrates a sectional view of a roll-packing machine according to an embodiment.

FIG. 2 shows a sectional view for schematically illustrating a roll-packing machine 100 which may be used for automated roll-packing of mattresses. In the following explanations, it is assumed that the roll-packing machine 100 is used for roll packing the mattress 10, thereby producing the mattress roll 20. In FIG. 2, a first horizontal direction is denoted by "x", and a vertical direction is denoted by "z". A second horizontal direction, extending perpendicular to the x-direction and the y-direction, i.e., perpendicular to the drawing plane, is denoted by "y". In the illustrated example, the roll-packing machine 100 is configured to perform a roll-packing process involving rolling of the mattress 10 around an axis in the y-direction.

As illustrated, the roll-packing machine 100 is provided with a belt-drive mechanism with a closed-loop belt 110 which is guided by rollers 121, 122, 123, 124, 125, 126. Rotational axes of the rollers 121, 122, 123, 124, 125, 126 extend in the y-direction. In the illustrated example, the belt 110 is assumed to be driven by the rollers 121 and 122. For this purpose, the rollers 121, 122 are provided with individually controllable drive mechanisms, e.g., respectively based on an electric motor coupled to a rotation shaft of the roller 121, 122. An advancement direction of the belt 110 is illustrated by arrows A.

As further illustrated, the belt drive mechanism is configured to form an inner loop 115 of the belt 110. As will be further explained below, the inner loop 115 acts as a rolling chamber for rolling the mattress 10. The inner loop 115 is formed in a portion of the belt 110 between the roller 121 and the roller 122. A size of the loop 115, i.e., the length of the portion of the belt 110 between the roller 121 and the roller 122, can be adjusted by individually controlling rotation of the roller 121 and the roller 122. When for example assuming an advancement of the belt 110 in the direction of the arrows A, the size of the loop 115 can be increased by controlling the roller 121 to rotate faster than the roller 122. Similarly, the size of the loop 115 can be decreased by controlling the roller 121 to rotate slower than the roller 122. Since the rollers 121, 122 are located at an entry into the inner loop 115, the rollers 121, 122 may also be referred to as entry rollers.

In the illustrated example, the roll-packing machine 100 is further provided with a tensioning mechanism for controlling tension of the belt 110. By means of the tensioning mechanism, the tension of the belt 110 can be maintained at a desired level, even when changing the size of the inner loop 115. In the example of FIG. 2, the tensioning mechanism includes a drive mechanism 150 for displacing the roller 124 of the belt drive mechanism with respect to other rollers 123 of the belt drive mechanism. The displacement of the roller 124 is illustrated by arrow B. By the displacement of the roller 124, a size of an additional loop of the belt 110, which is formed by the rollers 123, 124, and 125, can be adjusted. Specifically, the size of the additional loop can be set in such a way that it compensates changes of the size of the inner loop 115. For example, while increasing the size of the inner loop 115, the required additional length of the belt portion forming the inner loop 115 can be provided by reducing the size of the additional loop formed by the rollers 123, 124, and 125.

In the illustrated example, the roll-packing machine 100 is further provided with an ejection mechanism for allowing release and removal of the finished mattress roll 20 from the inner loop 115. In the illustrated example, the ejection mechanism is based on a drive mechanism which displaces the entry roller 121 away from the entry roller 122. In the example of FIG. 2, the rollers 121 and 126 of the belt drive mechanism are mounted on a tiltable support structure 155. By tilting the support structure as illustrated by arrow C, the entry roller 121 can be moved away from the entry roller 122, resulting in the inner loop 115 being opened, so that the mattress roll 20 formed in the inner loop 115 is released and can be removed.

In the illustrated example, the roll-packing machine 100 is further provided with a wrapping mechanism 160 for wrapping the rolled mattress 10 with a wrapping material, thereby forming the outer wrapping 25. In the illustrated example, the wrapping mechanism 160 is configured to introduce the wrapping material 25, which is supplied from a supply roll 161, into the inner loop 115 with the rolled mattress 10. A tool 162 may then be used for cutting and/or welding the wrapping material wrapped around the rolled mattress 10.

The roll-packing machine 100 further includes a feed mechanism for feeding the mattress 10 to the belt 110, in particular to the portion of the belt 110 between the entry rollers 121, 122. In the illustrated example, the feed mechanism includes a lower conveyor belt mechanism 130 and an upper conveyor belt mechanism 140. The lower conveyor belt mechanism 130 includes a belt 131 guided by rollers 132, 133, 134. One of the rollers 132, 133, 134, e.g., the roller 132, may be used for driving the belt 131. The upper conveyor belt mechanism 140 includes a belt 141 guided by rollers 142, 143. One of the rollers 142, 143, e.g., the roller 143, may be used for driving the belt 131. The mattress 10 is conveyed by advancing the lower conveyor belt mechanism 130 and the upper conveyor belt mechanism 140 in a direction as illustrated by arrow D. The feed mechanism may be opened for receiving the mattress. In the illustrated example, this is achieved by a drive mechanism 145 which displaces the roller 142 in a direction as illustrated by arrow D. By means of the drive mechanism 145 a part of the upper conveyor belt mechanism 140 may be moved away from the lower conveyor belt mechanism drive 130 to facilitate insertion of the mattress in an initial stage of the roll-packing process. After inserting the mattress 10, the drive mechanism 145 may be used to move the upper conveyor belt mechanism 140 toward the lower conveyor belt mechanism 130 so that the mattress 10 is sandwiched between the belt 131 of the lower conveyor belt mechanism 130 and the belt 141 of the upper conveyor belt mechanism 140. In some scenarios, this may also result in compression of the mattress 10 between the lower conveyor belt mechanism 130 and the upper conveyor belt mechanism 140. The distance between the lower conveyor belt mechanism 130 and the upper conveyor belt mechanism 140 may be adjustable to accommodate different mattress thicknesses and/or to adjust a degree of compression of the mattress 10.

Figure 3:
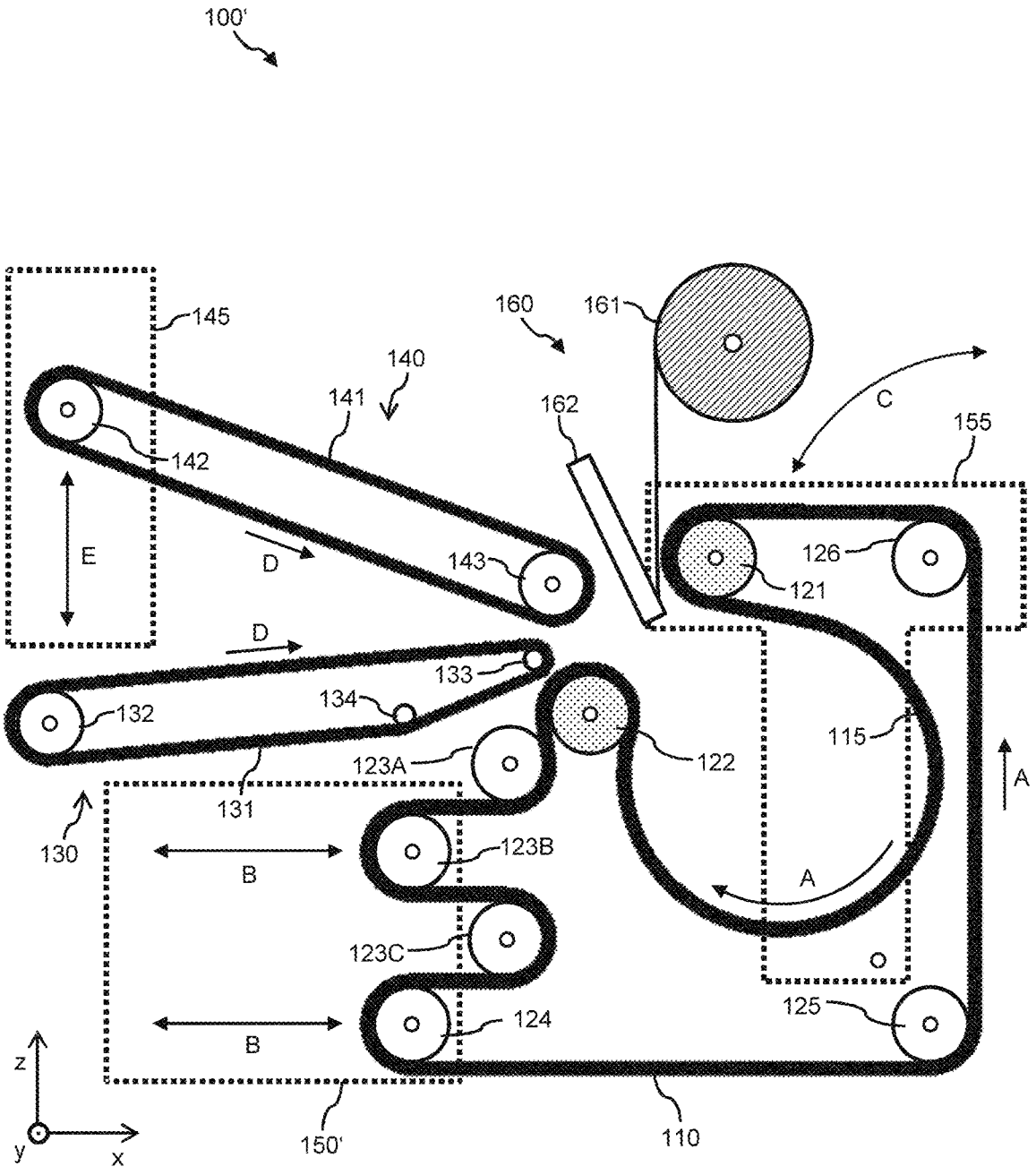
FIG. 3 schematically illustrates a sectional view of a roll-packing machine according to a further embodiment.

FIG. 3 shows a sectional view for schematically illustrating a further roll-packing machine 100' which may be used for automated roll-packing of mattresses, e.g., for roll packing the mattress 10, thereby producing the mattress roll 20. Similar to FIG. 2, in FIG. 3 a first horizontal direction is denoted by "x", and a vertical direction is denoted by "z". A second horizontal direction, extending perpendicular to the x-direction and the y-direction, i.e., perpendicular to the drawing plane, is denoted by "y". In the illustrated example, the roll-packing machine 100' is configured to perform a roll-packing process involving rolling of the mattress 10 around an axis in the y-direction.

In many aspects, the roll-packing machine 100' of FIG. 3 is similar to that of FIG. 2, and corresponding components of the roll-packing machine 100 and the roll-packing machine 100' are denoted by the same reference numerals. Further details concerning structure and functionality of these components in the roll-packing machine 100' can be taken from the description in connection with FIG. 2.

The roll-packing machine 100' differs from the roll-packing machine 100 in that the belt drive mechanism includes more additional loops for controlling the tension of the belt 110. In the roll-packing machine 100, the belt-drive mechanism includes rollers 121, 122, 123A, 123B, 123C, 124, 125, and 126 for guiding the belt 110. The rollers 121, 122, 124, 125, and 126 are similar to the rollers 121, 122, 124, 125, and 126 in the roll-packing machine 100. The rollers 123A, 123B, 123C replace the roller 123 of the roll-packing machine 100, thereby forming two additional loops (two outer loop, one inner loop) of the belt 100.

In the roll-packing machine 100' the tensioning mechanism for controlling tension of the belt 110 includes a drive mechanism 150' for displacing the rollers 123B and 124 of the belt drive mechanism with respect to other rollers of the belt drive mechanism. The displacement of the roller 123B, 124 is illustrated by arrows B. By the displacement of the rollers 123B, 124, the sizes of the additional loop of the belt 110, which are formed by the rollers 123A, 123B, 123C, 124, and 125, can be adjusted. Specifically, the sizes of the additional loops can be set in such a way that they compensate changes of the size of the inner loop 115. For example, while increasing the size of the inner loop 115, the required additional length of the belt portion forming the inner loop 115 can be provided by reducing the sizes of the additional loops formed by the rollers 123A, 123B, 123C, 124, and 125. In the roll-packing machine 100', the required range of displacement of the rollers 123B, 124 is lower than the required range of displacement of the roller 124 in the roll-packing machine 100. This may for example allow for a reduced space requirement of the roll-packing machine 100', e.g., in terms of a dimension of the roll-packing machine 100' in the x-direction.

Figure 4A:
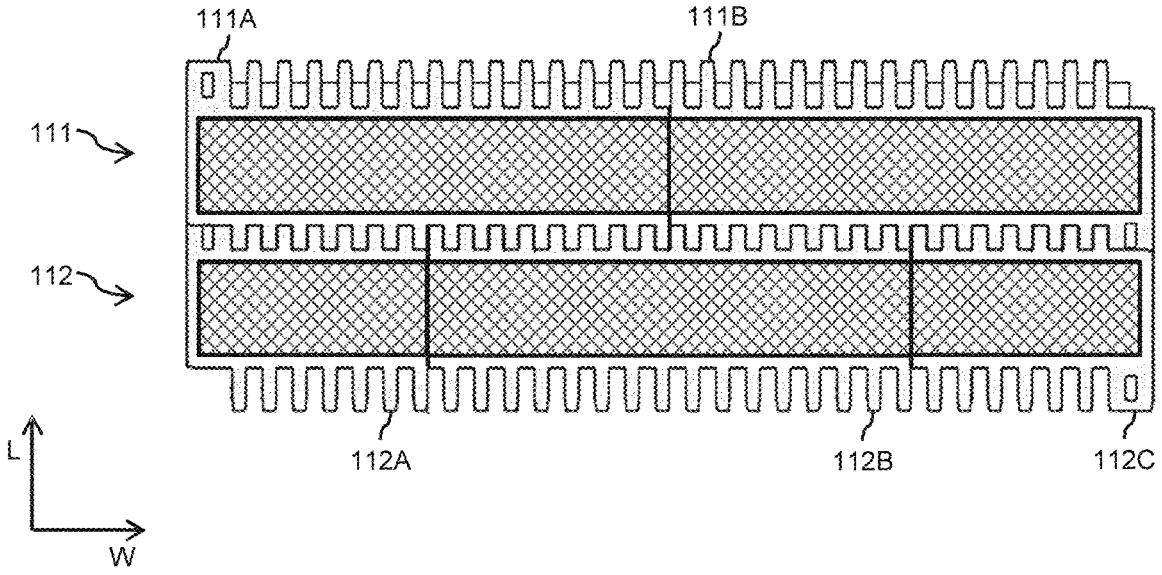
FIGS. 4A and 4B schematically illustrates elements of a segmented belt as utilized in a roll-packing machine according to an embodiment.
Figure 4B:
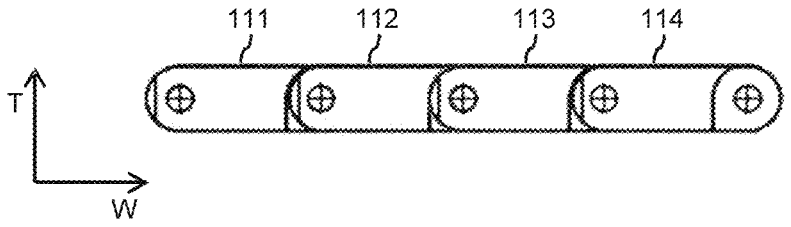

FIGS. 4A and 4B further illustrate an implementation of the belt 110 which may be used in the roll-packing machine 100 or the roll-packing machine 100'. More specifically, FIG. 4A shows a top view of a part of the belt 110, and FIG. 4B shows a side view of a part of the belt 110. In FIGS. 4A and 4B, a length direction of the belt 110 (along which the belt 110 is advanced in operation of the roll-packing machine 100, 100') is denoted by L, a width direction of the belt 110 (parallel to the axis of rolling the mattress 10) is denoted by W, and a thickness direction of the belt 110 is denoted by T.

In the illustrated example, the belt 110 is implemented as a segmented belt, i.e., formed of multiple segments 111, 112, 113, 114 which are joined together by hinged couplings. The segments 111, 112, 113, 114 themselves are assumed to be relatively rigid, with deformation of the segments 111, 112, 113, 114 during operation of the roll-packing machine 100, 100' being negligible. Flexibility of the belt 110 may thus be provided by the hinged joints couplings between the segments 111, 112, 113, 114, rather than by the material of the segments 111, 112, 113, 114. In this way, the belt may be provided with sufficient intrinsic stability to maintain the inner loop 115, without requiring dedicated support structures for maintaining the shape of the inner loop 115. Rather, stability of the inner loop may be provided by the entry rollers 121, 122, between which the inner loop 115 is formed, by the tension of the belt 110, and by a force generated by the mattress 10 which is being fed into the inner loop 115 and urges the inner loop 115 to expand. However, it is noted that while dedicated support structures may not be required, such support structures could nonetheless be present, e.g., in order to confine the inner loop 115 to a certain space or to avoid contact of the inner loop with other parts of the roll-packing machine 100, 100'.

The segments 111, 112, 113, 114 of the belt 110 may be formed of a plastic material. In this way, excessive weight of the belt 110 may be avoided while at the same time ensuring sufficient rigidity of the segments 111, 112, 113, 114. On a side facing the mattress 10 The segments 111, 112, 113, 114 may be provided with a surface material and/or a surface structure (in FIG. 4A indicated by cross-hatched regions) to provide a desired level of grip of the mattress 10 on the belt 110. For example, the segments 111, 112, 113, 114 could be provided with rubber elements which form or cover the cross-hatched regions. As illustrated, each of the segments 111, 112, 113, 114 may be composed from multiple subsegments 111A, 111B, 112A, 112B, 112C joined together along the width direction W. However, a single-piece configuration of each of the segments 111, 112, 113, 114 would be possible as well. In some scenarios, also the conveyor belt 131 and/or the conveyor belt 141 of the feed mechanism could be implemented as a segmented belt, e.g., with similar characteristics as explained in connection with FIGS. 4A and 4B.

FIGS. 5A-5H further illustrate the roll-packing process. While FIGS. 5A-5H assume a configuration of the roll-packing machine 100 as illustrated in FIG. 2, it is noted that a similar process could also be implemented using a configuration with more additional loops of the belt 110, e.g., using a configuration of the roll-packing machine 100' as illustrated in FIG. 3.

Figure 5A:
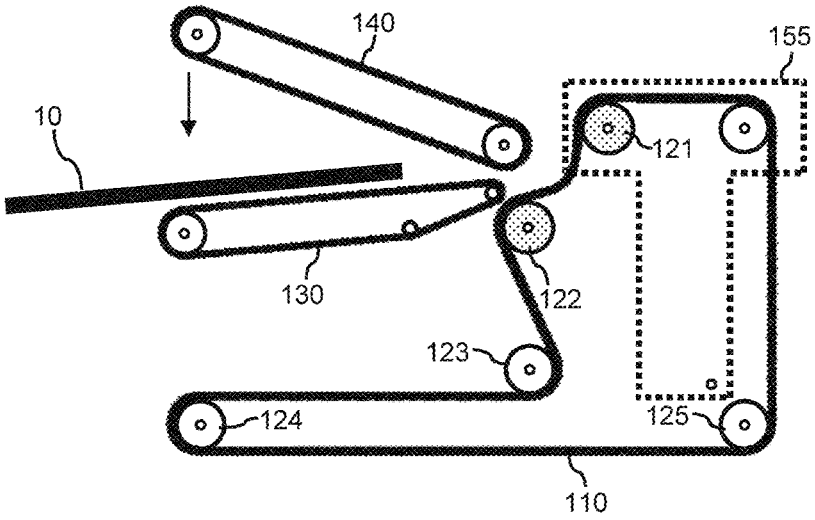
FIGS. 5A-5H schematically illustrate different stages of a roll-packing process according to an embodiment.

FIG. 5A illustrates an initial stage of the roll-packing process, in which the mattress 10 is inserted into the feed mechanism of the roll-packing machine 100. In this initial stage of the roll-packing process, the inner loop 115 of the belt 110 is absent or has only a small size. As illustrated, the mattress is placed on the lower conveyor belt mechanism 130, and the upper conveyor belt mechanism 140 is then lowered to sandwich the mattress 10 between the lower conveyor belt mechanism 130 and the upper conveyor belt mechanism 140. If desired, the mattress 10 may also be compressed between the lower conveyor belt mechanism 130 and the upper conveyor belt mechanism 140.

Figure 5B:
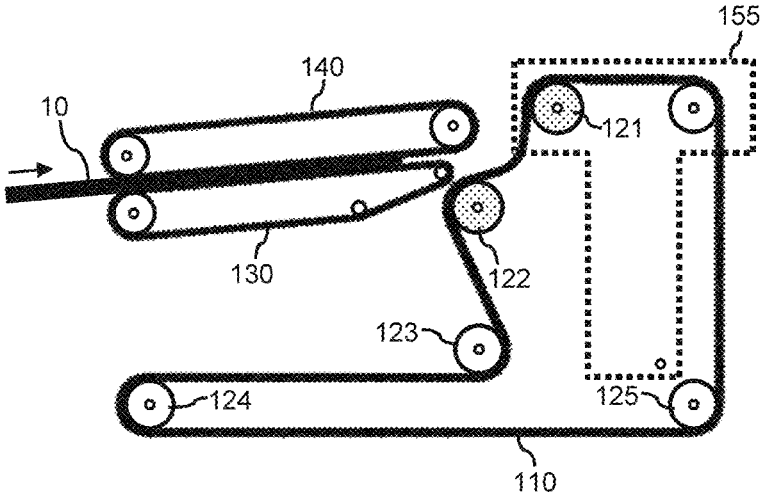

FIG. 5B illustrates a next stage of the roll-packing process, in which the mattress 10 is sandwiched, and optionally compressed, between the lower conveyor belt mechanism 130 and the upper conveyor belt mechanism 140. In this stage, the conveyor belt mechanisms 130, 140 are operated to convey the mattress 10 toward the portion of the belt 110 between the entry rollers 121, 122 until the mattress 10 eventually makes contact with the belt 110.

Figure 5C:
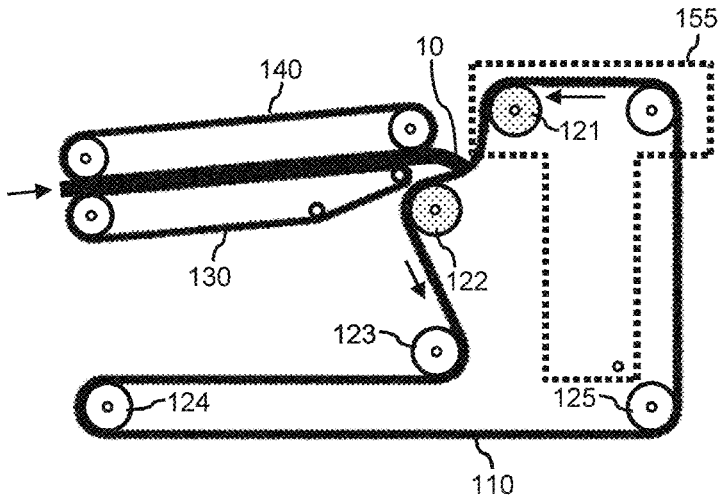

FIG. 5C illustrates a next stage of the roll-packing process, in which the mattress 10 has made contact with the belt 110. In this stage, the conveyor belt mechanisms 130, 140 are operated to further convey the mattress 10 toward the portion of the belt 110 between the entry rollers 121, 122. The mattress 10 exerts an inward force onto the belt 110. At the same time the belt 110 is advanced. The advancing belt 110 grips the end of the mattress 10 and pulls it toward the entry roller 122, thereby initiating rolling of the mattress 10. By controlling the roller 121 to rotate at a higher rate than the roller 122, the inner loop 115 is allowed to expanding under the force exerted by the mattress 10, as illustrated in FIG. 5D.

Figure 5D:
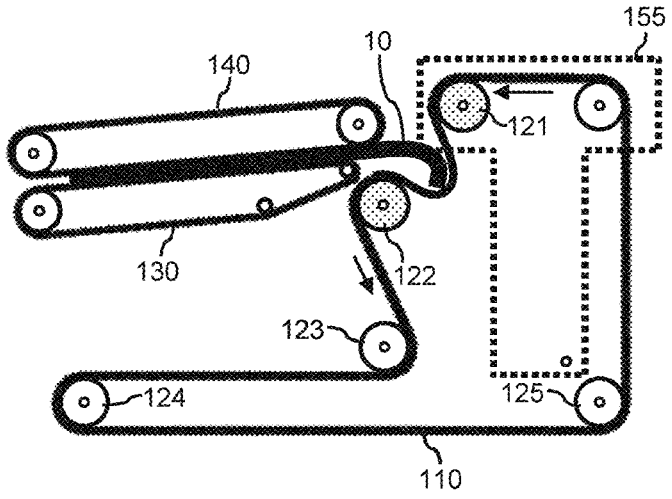
Figure 5E:
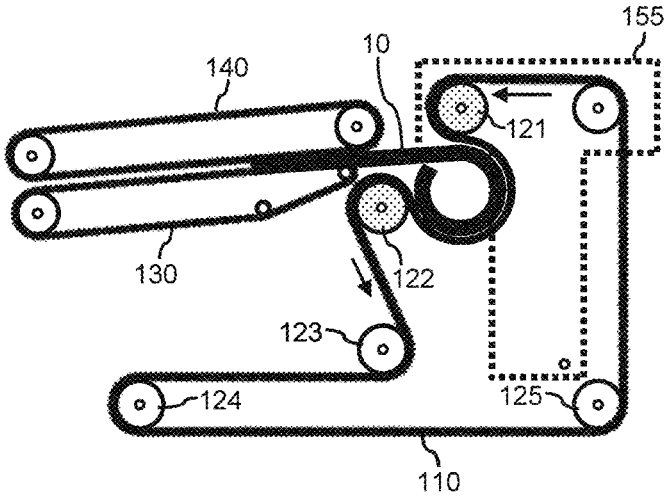
Figure 5F:
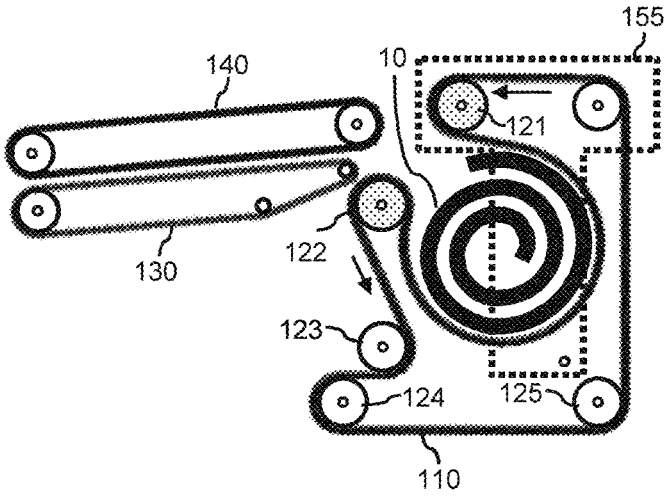

As illustrated by FIGS. 5D to 5F, the process of advancing the belt 110 while feeding the mattress 10 to the expanding inner loop 115 continues until the mattress 10 is fully received in the inner loop 115. As illustrated in FIG. 5F, this may result in the mattress 10 being rolled in multiple spiral-like windings. The additional belt length required for expansion of the inner loop 115 is provided by moving the roller 124 towards the roller 125, thereby reducing the size of the additional loop formed by the rollers 123, 124, and 125.

Figure 5G:
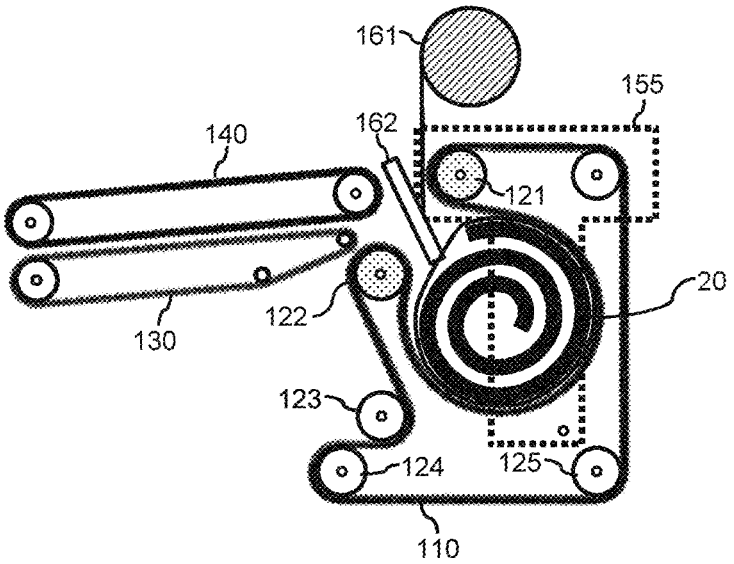

FIG. 5G illustrates a next stage of the roll-packing process, in which the fully rolled mattress 10 is wrapped with the wrapping material to form the mattress roll 20 with the outer wrapping 25. This is achieved by providing the wrapping material from the supply roll 161 into the inner loop 115 with the rolled mattress 10, while continuing to advance the belt 110. This causes rotation of the rolled mattress 10 in the inner loop 115, with the wrapping material being pulled in between the belt 110 and the rolled mattress 10. By completing one or more rotations of the rolled mattress 10 in the inner loop 115, the rolled mattress 10 is wrapped with one or more layers of the wrapping material. The cutting/welding tool 162 may then be used to cut the wrapping material and weld or otherwise fixate the wrapping material around the rolled mattress 20. At this point, the mattress roll is finished, but still enclosed in the inner loop 115.

Figure 5H:
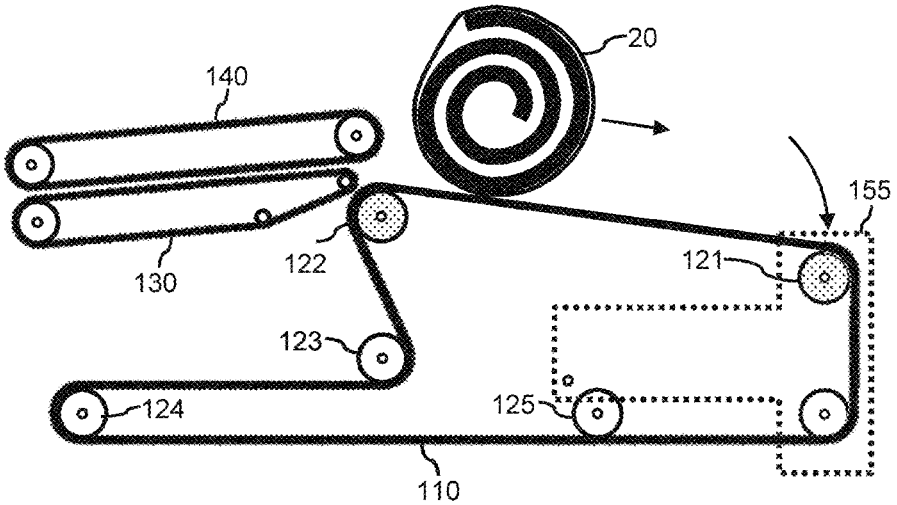

FIG. 5H illustrates a next stage of the roll-packing process, in which the finished mattress roll 20 is ejected from the inner loop 115 and the roll-packing machine 100. This is achieved by tilting the support structure 155, thereby moving the entry roller 122 away from the entry roller 121. The movement of the entry roller 122 opens the inner loop 115 so that the mattress roll 20 is released and can be removed. As illustrated in FIG. 5H the movement of the entry roller 122 may cause that the portion of the belt 110 between the entry rollers assumes a straight-line form so that the mattress roll 20 can be removed from the roll-packing machine 100 by rolling along the belt 110. This rolling of the mattress roll 20 can be facilitated by moving the entry roller 122 to a lower vertical position than the entry roller 121, so that rolling of the mattress roll 20 from the roll-packing machine 100 can be driven or at least assisted by gravity force. Alternatively or in addition, removal of the mattress roll 20 from the roll-packing machine 100 could be accomplished by driving the belt 110 to convey the mattress roll 20 from the roll-packing machine 100. For example, in the situation illustrated in FIG. 5H, the belt 110 could be driven oppositely to the above-mentioned advancement direction A used during rolling of the mattress 10. When moving the entry roller 122 away from the entry roller 121 a decrease of the length of the belt portion between the entry rollers 121, 122 may be compensated by moving the roller 124 back away from the roller 125.

Figure 6:
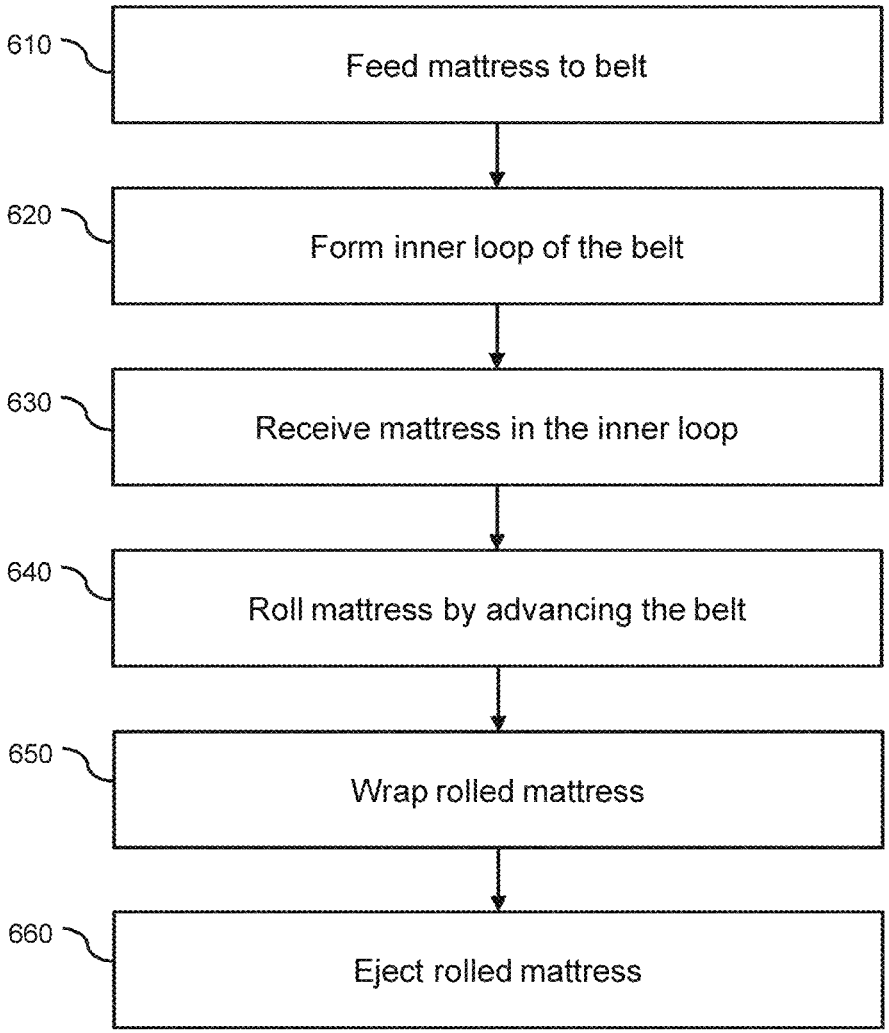
FIG. 6 shows a flowchart for illustrating a method according to an embodiment of the invention.

FIG. 6 shows a flowchart for illustrating a method of roll-packing a mattress, e.g., the above-mentioned mattress 10. The method of FIG. 6 may be used to implement the above-described concepts and may be performed by a roll-packing machine, e.g., the above roll-packing machine 100 or 100'.

At block 610 the mattress is fed to a closed-loop belt of a belt drive mechanism, e.g., a belt drive mechanism as described in connection with FIG. 2 or a belt drive mechanism as described in connection with FIG. 3. The belt may be a segmented belt, e.g., as described in connection with FIGS. 4A and 4B for the belt 110. The feeding of the mattress may be performed by a feed mechanism, e.g., a feed mechanism based on one or more conveyor belt mechanisms as illustrated in FIGS. 2 and 3. In some scenarios, the mattress may be compressed while being fed to the belt.

At block 620, an inner loop of the belt is formed, e.g., like the above-mentioned inner loop 115. An example of the formation of the inner loop is illustrated in FIGS. 5C and 5D, and at block 630, the mattress is received in the inner loop, e.g., as illustrated by FIGS. 5C to 5E. As explained above, the belt drive mechanism may be provided with a first roller and a second roller between which the inner loop is formed, e.g., the above-mentioned entry rollers 121, 122. Formation of the inner loop may then involve individually controlling rotation of the first roller and the second roller. Specifically, by controlling the first roller and the second roller to rotate at different rates, the inner loop may be formed while the mattress fed to the belt exerts an inward force onto the belt.

At block 640 the mattress is rolled by advancing the belt while the mattress is received in the inner loop, e.g., as illustrated in FIGS. 5C to 5F. In some scenarios, this may involve adjusting the size of the inner loop while the mattress is being rolled. As explained above, the belt drive mechanism may be provided with a first roller and a second roller between which the inner loop is formed, e.g., the above-mentioned entry rollers 121, 122. Adjusting the size of the inner loop may then involve individually controlling rotation of the first roller and the second roller. Specifically, by controlling the first roller and the second roller to rotate at different rates, the size of the inner loop may be increased in accordance with an increase of the diameter of the rolled mattress.

At optional block 650, the rolled mattress is wrapped. This may involve feeding a wrapping material into the inner loop with the rolled mattress and advancing the belt to rotate the rolled mattress in the inner loop and wrap the wrapping material around the rolled mattress. An example of such wrapping process is described in connection with FIG. 5G.

At optional block 660, the rolled mattress is ejected from the inner loop. As explained above, the belt drive mechanism may be provided with a first roller and a second roller between which the inner loop is formed, e.g., the above-mentioned entry rollers 121, 122. Ejecting the rolled mattress may then involve displacing the first roller away from the second roller. An example of such ejection process is described in connection with FIG. 5H.

It is noted that the flowchart of FIG. 6 is not intended to imply a strict order of the illustrated actions and that the illustrated actions may for example overlap or be otherwise combined with each other.

It is to be understood that the illustrated roll-packing machine 100, 100' and its operations are susceptible to various modifications, without departing from the illustrated concepts. For example, the geometry, number and arrangement of rolls in the belt-drive mechanism could be varied. Further, various types of feed mechanisms could be used for feeding the mattress to the belt and into the inner loop, e.g., feed mechanisms based on conveyor rollers or conveyor wheels. Still further, other way of fixating the mattress roll 20 could be used in addition or as an alternative to the outer wrapping 25, e.g., fixation by welding a wrapping present on the mattress 10 itself or fixation by using one or more strings or bands around the rolled mattress 10.

The invention claimed is:

1. A roll-packing machine for packaging a mattress, the roll-packing machine comprising:

a belt drive mechanism comprising a closed-loop belt;

a feed mechanism configured to feed the mattress to the belt;

a supply roll of wrapping material;

a tool for cutting the wrapping material;

wherein the belt drive mechanism is configured to form an inner loop of the belt, to receive the mattress in the inner loop, and to roll the mattress and one or more layers of the wrapping material by advancing the belt while the mattress and one or more layers of the wrapping material are received in the inner loop, wherein the belt drive mechanism comprises a first roller and a second roller, the inner loop being formed between the first roller and the second roller, wherein the belt drive mechanism is configured to adjust a size of the inner loop by individually controlling rotation of the first roller and the second roller, and wherein the first and second rollers may be separated, resulting in the inner loop being opened, so that a mattress roll formed and wrapped in the inner loop is released and removed.

2. The roll-packing machine of claim 1, wherein the first roller and the second roller are located at an entry into the inner loop.

3. The roll-packing machine of claim 1, wherein the belt drive mechanism is configured to increase the size of the inner loop while the mattress is being rolled.

4. The roll packing machine of claim 1, further comprising a belt tensioning mechanism configured to control tension of the belt while adjusting the size of the inner loop.

5. The roll packing machine of claim 4, wherein the belt tensioning mechanism is configured to control the tension of the belt by adjusting a size of one or more additional loops of the belt.

6. The roll packing machine of claim 5, wherein the belt drive mechanism comprises multiple rollers for guiding the belt, and wherein the tensioning mechanism is configured to adjust the size of the one or more additional loops by displacing two or more of the rollers relative to each other.

7. The roll-packing machine of claim 1, wherein only one of the first and second rollers is movable with a tiltable support structure.

8. The roll-packing machine of claim 7, wherein the roller movable with the tiltable support structure is below the other roller of the first and second rollers when the tiltable support structure is in a down position so gravity may assist moving the mattress roll along the belt and out of the roll-packing machine.

9. The roll-packing machine of claim 1, further comprising a tiltable support structure independent of the feed mechanism, wherein the first and second rollers may be separated by the tiltable support structure.

10. The roll-packing machine according to claim 1, wherein the belt is a segmented belt.

11. The roll-packing machine according to claim 1, wherein the feed mechanism is configured to compress the mattress while feeding the mattress to the belt.

12. The roll-packing machine according to claim 1, wherein the feed mechanism comprises a lower conveyor belt mechanism and an upper conveyor belt mechanism above the lower belt mechanism, the upper and lower conveyor belt mechanisms being separate from the belt drive mechanism, the lower conveyor belt mechanism being stationary and the upper conveyor belt mechanism being movable from an upper position to a lowered position to sandwich the mattress between the lower and upper conveyor belt mechanisms when the upper conveyor belt mechanism is in its lowered position.

13. The roll-packing machine of claim 1, wherein the first and second rollers may be separated by tilting a tiltable support structure, resulting in the inner loop being opened, so that a mattress roll formed in the inner loop is released and removed by rolling along the belt above the tiltable support structure.

14. A roll-packing machine for packaging a mattress, the roll-packing machine comprising:

a belt drive mechanism comprising a closed-loop belt;

a feed mechanism configured to feed the mattress to the belt;

a tiltable support structure independent of the feed mechanism, wherein the belt drive mechanism is configured to form an inner loop of the belt, to receive the mattress in the inner loop, and to roll the mattress by advancing the belt while the mattress is received in the inner loop, wherein the belt drive mechanism comprises a first roller and a second roller, the inner loop being formed between the first roller and the second roller, wherein the belt drive mechanism is configured to adjust a size of the inner loop by individually controlling rotation of the first roller and the second roller, and wherein the first and second rollers may be separated by tilting the tiltable support structure, resulting in the inner loop being opened, so that a mattress roll formed in the inner loop is released and removed and wherein the roll-packing machine is further configured to wrap the rolled mattress by:

feeding a wrapping material into the inner loop with the rolled mattress; and advancing the belt to rotate the rolled mattress in the inner loop and wrap the wrapping material around the rolled mattress.

15. The roll-packing machine of claim 14, wherein the first roller and the second roller are located at an entry into the inner loop.

16. The roll-packing machine of claim 14, wherein the belt drive mechanism is configured to increase the size of the inner loop while the mattress is being rolled.

17. The roll packing machine of claim 14, further comprising a belt tensioning mechanism configured to control tension of the belt while adjusting the size of the inner loop.

18. The roll packing machine of claim 17, wherein the tensioning mechanism is configured to control the tension of the belt by adjusting a size of one or more additional loops of the belt.

19. The roll packing machine of claim 18, wherein the belt drive mechanism comprises multiple rollers for guiding the belt, and wherein the tensioning mechanism is configured to adjust the size of the one or more additional loops by displacing two or more of the rollers relative to each other.

20. The roll-packing machine of claim 14, wherein only one of the first and second rollers is movable with the tiltable support structure.

21. The roll-packing machine of claim 20, wherein the roller movable with the tiltable support structure is below the other roller of the first and second rollers when the tiltable support structure is in a down position so gravity may assist moving the mattress roll along the belt and out of the roll-packing machine.

22. The roll-packing machine according to claim 14, wherein the feed mechanism is configured to compress the mattress while feeding the mattress to the belt.

23. A roll-packing machine for packaging a mattress, the roll-packing machine comprising:

a belt drive mechanism comprising a closed-loop belt;

a feed mechanism configured to feed the mattress to the belt;

a supply roll of wrapping material;

a tool for cutting the wrapping material;

wherein the belt drive mechanism is configured to form an inner loop of the belt, to receive the mattress in the inner loop, and to roll the mattress and one or more layers of the wrapping material by advancing the belt while the mattress and one or more layers of the wrapping material are received in the inner loop, wherein the belt drive mechanism comprises a first roller and a second roller, the inner loop being formed between the first roller and the second roller, wherein the belt drive mechanism is configured to adjust a size of the inner loop by individually controlling rotation of the first roller and the second roller, and wherein the first and second rollers may be separated, resulting in the inner loop being opened, so that a mattress roll formed and wrapped in the inner loop is released and removed; and wherein the roll-packing machine is further configured to wrap the rolled mattress by:

feeding a wrapping material into the inner loop with the rolled mattress; and advancing the belt to rotate the rolled mattress in the inner loop and wrap the wrapping material around the rolled mattress.

* * * * *